United States Patent [19]

Kuiper

[11] Patent Number: 5,076,036

[45] Date of Patent: Dec. 31, 1991

[54] SUSPENSION SYSTEM FOR CEILING PANELS, AND A SECTIONAL BAR FOR SUCH A SYSTEM

[76] Inventor: Karel Kuiper, Stationslaan 52, 8071 CN Nunspeet, Netherlands

[21] Appl. No.: 493,515

[22] Filed: Mar. 14, 1990

[30] Foreign Application Priority Data

Mar. 16, 1989 [NL] Netherlands ..... 8900651

[51] Int. Cl.[5] ..... E04B 9/12; E04B 9/18

[52] U.S. Cl. ..... 52/488; 52/484; 52/665

[58] Field of Search ..... 52/484, 488, 665

[56] References Cited

U.S. PATENT DOCUMENTS

| | | | |
|---|---|---|---|
| 3,334,465 | 8/1967 | Hoffmann, Jr. | 52/484 |
| 3,596,425 | 8/1971 | Kodaras | 52/665 |
| 4,206,578 | 6/1980 | Mieyal | 52/484 |
| 4,520,609 | 6/1985 | Worley et al. | 52/484 |

FOREIGN PATENT DOCUMENTS

| | | | |
|---|---|---|---|
| 12098 | 4/1969 | Australia | 52/484 |

*Primary Examiner*—Michael Safavi

*Attorney, Agent, or Firm*—Edmund M. Jaskiewicz

[57] ABSTRACT

Suspension system for ceiling panels, comprising a supporting grid of interconnected bars intersecting one another at right angles, said grid being supported below an existing ceiling structure, and said sectional bars when fitted having a vertical web portion which has fitted at the bottom end on either side thereof horizontal side flanges for the purpose of supporting the ceiling panels. The web portion of the sectional bars at the top end being provided with a hollow tubular part and the sectional bars being connected to each other by means of connecting elements each having at least one insertion part accommodated in the tubular part. The tubular part is elongated in shape, viewed in the vertical direction of the web portion. The sectional bars are suspended at regular intervals by means of hooked suspension elements. Said hooked suspension elements as well as the connecting elements being formed of sheet material. The tubular part at the top side being provided with apertures for accommodation of the hooked suspension elements and with apertures for a hooked lip of the connection elements.

8 Claims, 3 Drawing Sheets

SUSPENSION SYSTEM FOR CEILING PANELS, AND A SECTIONAL BAR FOR SUCH A SYSTEM

Suspension system for ceiling panels, comprising a supporting grid of interconnected sectional bars intersecting one another at right angles, said grid being supported below an existing ceiling structure, and said sectional bars when fitted having a vertical web portion which has fitted at the bottom end on either side thereof horizontal side flanges for the purpose of supporting the ceiling panels, the web portion of the sectional bars at the top end being provided with a hollow tubular part and the sectional bars being connected to each other by means of connecting elements each having at least one insertion part accommodated in the tubular part.

Such a suspension system is known from DE-A-1 021 555. Said known system does not show any means for suspending the grid or frame assembly to the existing ceiling structure. Further the connecting elements as well as the sectional bars have a rather complicated configuration and are therefore difficult to manufactor.

SUMMARY OF THE INVENTION

The object of the present invention is now to provide a suspension system for ceiling panels which is cheap to produce, in which the sectional bars are easily and quickly connected to each other, and in which the suspension elements as well as the connecting elements do not constitute any hindrance when the ceiling panels are being placed in the supporting grid.

These objects are achieved according to the invention in that the the tubular part is elongated in shape, viewed in the vertical direction of the web portion, the sectional bars are suspended at regular intervals by means of hooked suspension elements , said hooked suspension elements as well as the connecting elements being formed of sheet material, and the tubular part at the top side is provided with apertures for accommodation of the hooked suspension elements.

This design of the sectional bars has the advantage that the tubular part of the web portion serves to accommodate the hooked suspension elements, so that the hook portions of the suspension elements are essentially housed in said tubular part and thus are directed in the lengthwise direction of the sectional bars. These hook portions thus constitute no hindrance at all when the ceiling panels are being fitted.

Another advantage is that the connecting elements can be inserted at the ends of the sectional bars by their insertion part into the tubular part and fixed therein. This has the advantage that it is possible to use a sectional bar which is roll-formed from sheet material and can be cut to pieces of a desired length.

For the formation of a right-angled connection between two sectional bars, in which the end of one sectional bar must connect at right angles to another sectional bar, the invention provides for a connecting element which is accommodated with its insertion part in the tubular part of one sectional bar and is provided with a supporting part which projects beyond said sectional bar and rests against the other sectional bar and has a hooked lip which is designed to engage in an aperture provided in the top side of the tubular part of the other sectional bar, in such a way that the side flanges of the two sectional bars are coplanar with each other and abut to each other with a right angle.

In case, for forming an intersection, on either side of a continuous sectional bar another sectional bar is connected , it is desirable for the two other sectional bars to be accurately in line with each other. In order to achieve this, the hooked lip of the connecting element is according to the invention displaced to one side relative to the vertical longitudinal centre face of the sectional bar in which it is accommodated with its insertion part.

In order to provide greater stability in the right-angled connection between two sectional bars, the supporting part of the connecting element according to the invention is provided with at least one laterally directed supporting face which after fitting rests against the part of the body part of the sectional bar lying below the tubular part and in which the hooked lip also engages.

In a preferred embodiment of the invention the supporting part is provided at the bottom edge with a recess which accommodates a longitudinal ridge provided in each side flange of the setional bars. In combination with the at least one supporting face which engages under the tubular part, the recess in the bottom edge constitutes a snap-connection. The longitudinal ridge engages the recess if the supporting face engages under the tubular part of the sectional bar.

The invention will be explained in greater detail with reference to the accompanying drawings.

DETAILED DESCRIPTION OF THE DRAWINGS

Figure 1:
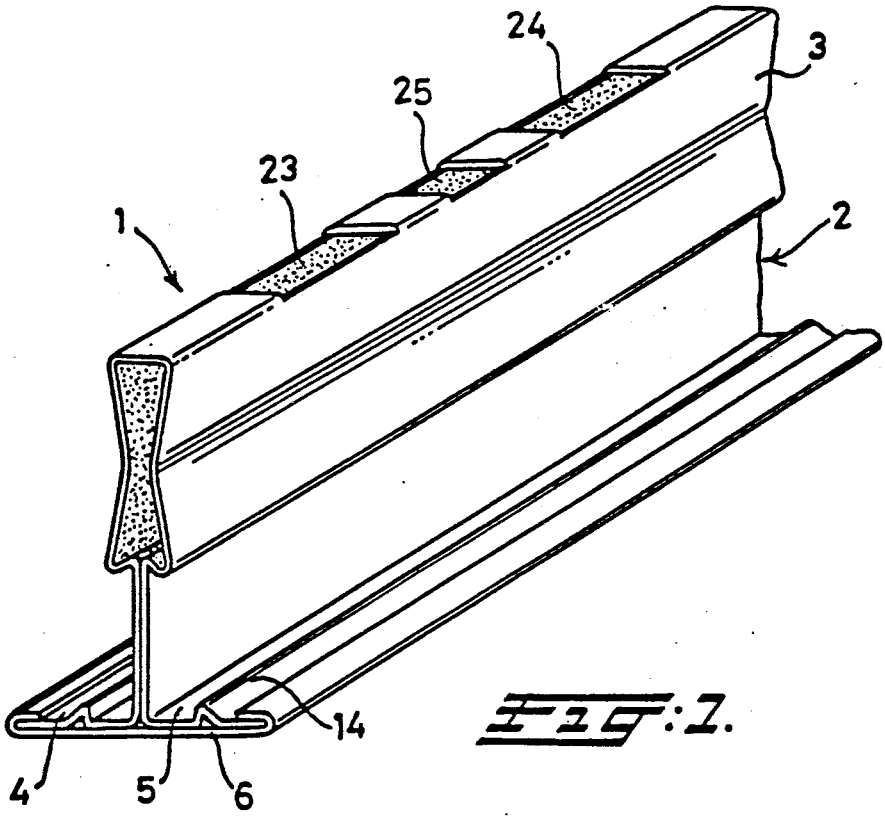
FIG. 1 is a perspective view of a part of a sectional bar for a suspension system according to the invention.

The sectional bar 1 shown partially and in perspective in FIG. 1 is in general the shape of an inverted T, with a web portion 2 which in the fitted position shown is positioned vertically and at the top side comprises a hollow tubular part 3. The tubular part is elongated in shape with walls curved slightly inwards. Apertures, the purpose of which will be explained later, are provided in the top wall of the tubular part. As can be seen clearly from the drawing, the sectional bar is roll-formed from sheet material which in the web portion is folded together leaving free the top tubular part 3, and then at the bottom side is flanged with a right angle to both sides to form side flanges 4, 5 on which the ceiling panels come to rest. The side flanges 4, 5 are covered at the bottom side by a covering strip 6, in order to give the sectional bar a smooth appearance when fitted.

These sectional bars are designed to form a supporting grid with rectangular or square apertures. The supporting grid is suspended by means of suspension elements from an existing ceiling structure, and the apertures in the grid are then filled up with ceiling panels (not shown), which rest on the above-mentioned side flanges.

Figure 3:
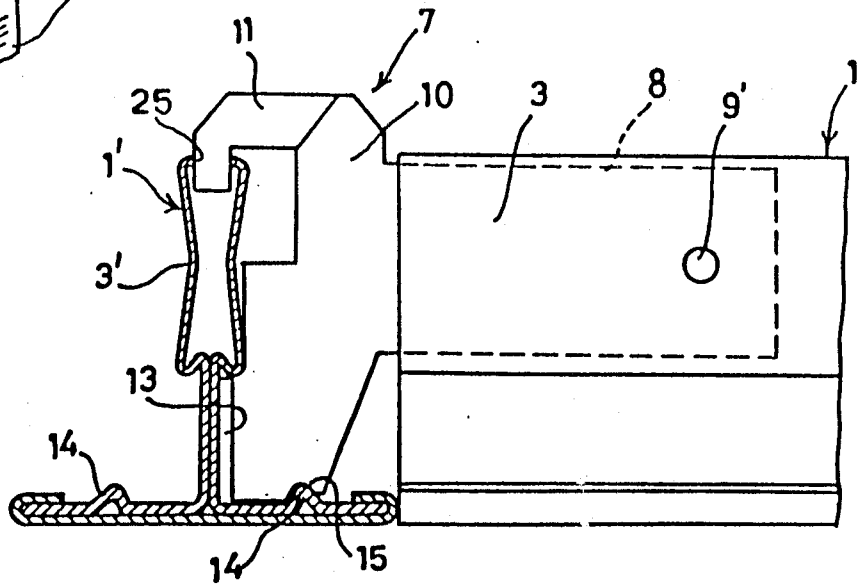
FIG. 3 is view of a right-angled connection between two sectional bars.
Figure 2:
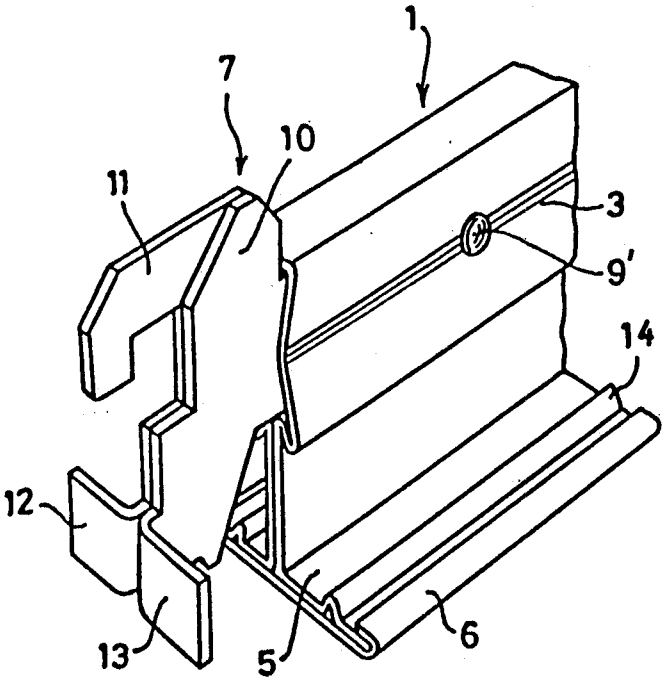
FIG. 2 is a perspective view of a part of a sectional bar with a connecting element fixed therein for the formation of a right-angled connection.

For the formation of such a supporting grid, it is necessary for the different sectional bars to be connected together. For this, special connecting elements which mate with the sectional bars just described have been developed. A first connecting element 7, which is designed to form a right-angled T-connection between two sectional bars is shown in FIGS. 2 and 3.

The connecting element 7 is fixed at the end of a sectional bar 1 by means of an insertion part 8 inserted into the hollow tubular part 3 of the sectional bar. The insertion part 8 is of such dimensions that it fits without excessive play into the tubular part, while the inwardly curved side walls of said part exert a clamping action on the insertion part. The insertion part 8 is also provided with an aperture 9 which serves to secure the connecting element in the sectional bar 1. This is carried out by providing depressions in the tubular part of the sectional bar from the outside at the level of the aperture 9 using a suitable tool, said depressions engaging with the aperture 9 and fixing the connecting element.

The part of the fixing element projecting beyond the sectional bar 1 is formed by a supporting element 10 which at the top side is provided with a hooked lip 11. As can be seen clearly from FIG. 3, the supporting part 10 lies against the web portion and against a side flange of a second sectional bar 1' placed at right angles to the sectional bar 1 and to be connected thereto, while the hooked lip 11 engages in an aperture provided at the top side of the tubular part 3' of the sectional bar 1'.

In order to increase the stability of this connection, the supporting part 10 is provided with two supporting faces 12, 13 which are at right angles thereto and rest against the part of the body part of the sectional bar 1' lying below the tubular part 3'.

As can be seen clearly from the drawing, the side flanges 4 and 5 of each sectional bar are provided with a ridge 14 running in the lengthwise direction, which mates with a recess 15 formed on the bottom edge of the supporting part 10, in order to fix the sectional bar 1' in such a way relative to the sectional bar 1 that the side flanges of the two sectional bars abut accurately against each other. In combination with the supporting faces 12 and 13 engaging under the tubular part, the recess 15 together with the ridge 14 constitute a snap-connection.

Figure 4:
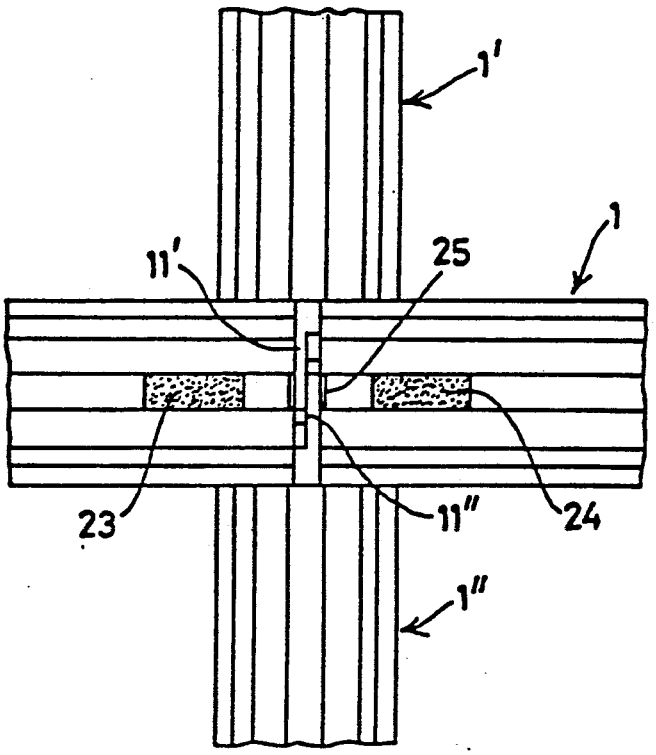
FIG. 4 is a top view of a right-angled connection between a sectional bars forming an intersection.

As can be seen in particular from FIG. 2, the connecting element 7 comprises two plate-shaped parts which are placed against each other and connected to each other, and which, with the exception of the hooked lip 11, are identical in shape and are mirror symmetrical relative to the supporting faces 12 and 13. This configuration means that the hooked lip 11 is displaced sideways relative to the central longitudinal plane of symmetry of the sectional bar 1. The object of this arrangement will become clear with reference to FIG. 4, which shows a top view of an intersection formed by the sectional bars with one continuous sectional bar 1 and on either side thereof a sectional bar 1' and 1'' connecting at right angles thereto. The lips 11' and 11'' of the connecting elements 7' and 7'' connected to the bars 1' and 1'' in this case lie next to each other to engage in the same aperture of the sectional bar 1, while the sectional bars 1' and 1'' lie accurately in line with each other.

Figure 5:
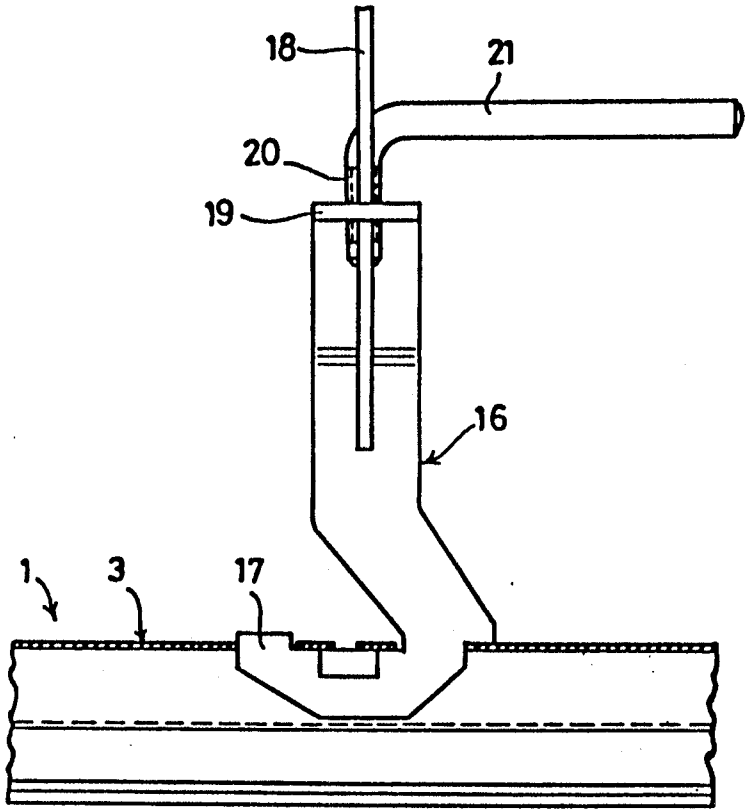
FIG. 5 is a partially sectioned side view of a part of the bar containing a suspension element.

FIG. 5 shows a longitudinal section of a sectional bar 1 with a suspension element 16 fitted therein. The suspension element which is made of sheet metal comprises a hook portion 17 which engages in two apertures spaced apart in the top wall of the tubular part 3 of the sectional bar 1. As can be seen clearly in this figure, the hook portion lies in the lengthwise direction of the sectional bar 1, and the hook portion 17 is essentially accommodated inside the tubular part 3. The suspension element 16 is connected by means of a pressure connection to a rod 18, which is in turn connected to an existing ceiling structure. The suspension element 16 has at the top end a horizontal face 19 and has a threaded aperture into which an externally threaded arm 20 of an operating lever 21 is screwed. The externally threaded arm 20 is provided with a recess or a flattened side 26 which together with a recess 27 in the threaded aperture in the face 19 leaves sufficient space for pushing through the rod 18 see also FIG. 7). When the ever 20 is turned, the rod 18 is clamped, in which case the external screw thread of the arm 20 cuts into the rod 18 and in this way produces a firm connection between the rod 18 and the connecting element, said connection being capable of withstanding impacts and vibrations.

Figure 7:
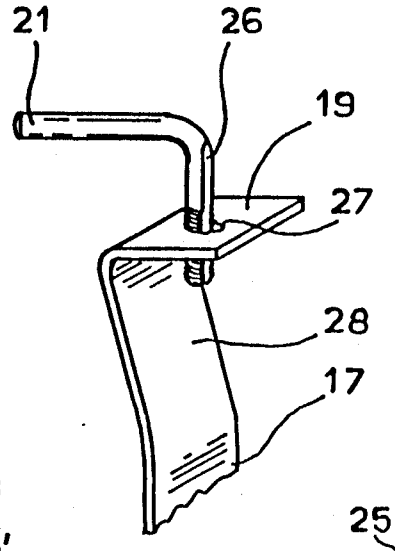
FIG. 7 shows a perspective view of the top side of a connecting element.

As can be clearly seen in FIG. 7 the horizontal face 19 merges via an acute angle into a sloping face 28 which in turn merges in the vertical hook portion 17. By this configuration the connecting element is somewhat resilient in the vertical direction which has the advantage that vibrations and impacts do not affect the pressure connection between the rod 18 and the suspension element.

Figure 6:
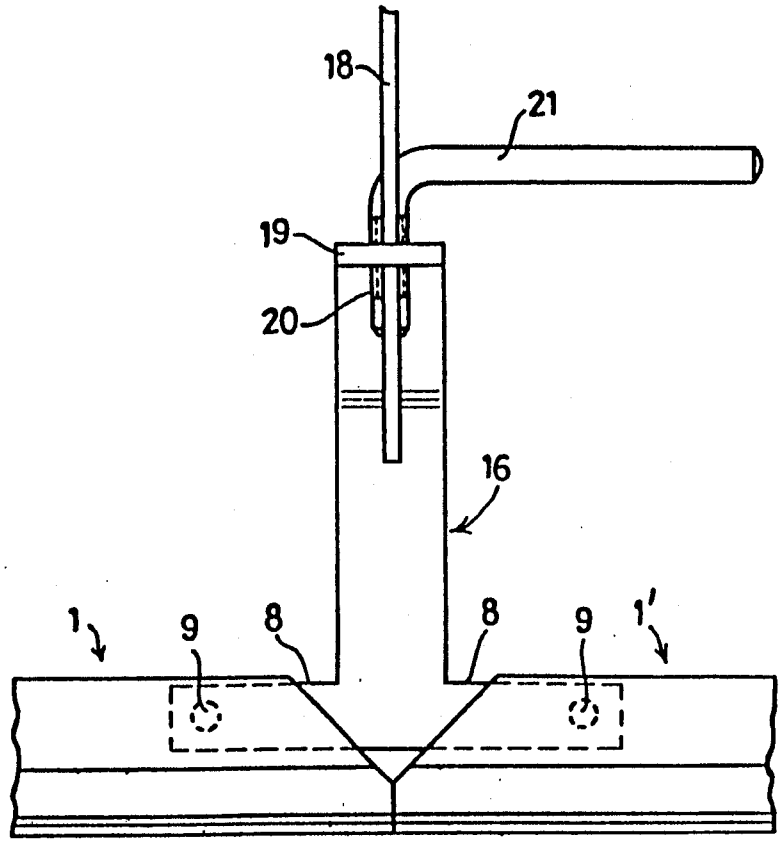
FIG. 6 shows the connection between two sectional bars lying in line with each other and combined with a suspension element.

FIG. 6 shows another connecting element 22 which is designed to connect together two sectional bars 1 and 1' in the lengthwise direction. The connecting element 22 is to this end provided with two insertion parts 8 which lie in line with each other and are each provided with an aperture 9. The two sectional bars 1 and 1' are pushed on either side onto the appropriate insertion parts 8 until the sectional bars 1 and 1' are resting against each other.

With a suitable tool, depressions 9' are then made in the sectional bars from the outside at the level of the apertures 9, in order to fix the sectional bars to the connecting element.

In the embodiment shown in FIG. 6, the connecting element 22 is combined with a suspension element of the type described above with reference to FIG. 5.

In the sectional bar 1 shown in FIG. 1 a group of three apertures is provided in the top side of the tubular part 3. Such groups are provided at regular intervals from each other along the length of the sectional bars. The outermost apertures 23 and 24 are designed to accommodate the hook portion 17 of a suspension element 16, while the smaller central apertures 24 are for accommodating the hooked lips 11 of the connecting elements 7 (see also FIG. 4 . It will be clear that these apertures can be provided at the factory. If necessary, apertures can be provided in the sectional bars at the other points for instance by using a file, so that the supporting grid can easily be adapted to local conditions.

The suspension system according to the invention is of a considerably lighter and more rigid construction than the existing systems. The sectional bars can easily be adapted to the local circumstances, and the connecting elements as well as the suspension elements are easily and cheap to manufactore from sheet metal. The most important advantage is, however, that the suspension system is much quicker and easier to fit.

The invention is not limited to the embodiment shown and discussed here, but a large number of modifications are possible within the scope of the invention. It is for instance possible that the connecting element exists of a single plate-part, in which case said connecting element comprises only one supporting face and the hooked lip 11 is slightly bent sidewards.

What is claimed is:

1. Suspension system for ceiling panels, comprising a supporting grid of interconnected sectional bars intersecting one another at right angles, said grid being supported at a certain distance below an existing ceiling structure, a plurality of sectional bars each having a vertical web portion which has at the bottom end on either side thereof horizontal side flanges for the purpose of supporting the ceiling panels, the web portion of a said sectional bar having at the top end thereof a hollow tubular part and the sectional bars being connected to each other by means of connecting elements, the sectional bars are suspended at regular intervals by suspension elements each having a hook portion thereon, and the hollow tubular part has a top wall having therein two spaced apertures along the length of the suspension bar to receive a said hook portion such that the hook portion is accommodated within said hollow tubular part.

2. Suspension system according to claim 1, wherein a said connecting element for forming a right-angled connection between two sectional bars has at least one, insertion part received within a tubular part of and further has a supporting part which projects beyond said sectional bar and in the fitted position rests against the web portion of the other sectional bar, and has a hooked lip which engages in an aperture provided in the top wall of the tubular part of the said other sectional bar.

3. Suspension system according to claim 2, wherein the supporting part of the connecting element is provided with at least one laterally directed supporting face which after fitting rests against the part of the web portion of the other sectional bar lying below the tubular part in which the hooked lip also engages.

4. Suspension system according to claim 3, wherein, the supporting part is provided at the bottom edge with a recess which accommodates a longitudinal ridge provided in each side flange of the sectional bars.

5. Suspension system according to claim 3 wherein the hooked lip of the connecting elements is displaced to one side relative to the vertical longitudinal centre face of the sectional bar in which it is accommodated with its insertion part.

6. Suspension system according to claim 1, wherein the suspension elements are each connected to a rod which is in turn connected to a ceiling structure, each of the suspension elements has at the top end a horizontally directed end face with a threaded arm of an operating lever is screwed, said arm being provided with a recess which together with a recess in the threaded aperture leave sufficient space for pushing through the rod, said rod being clamped by rotating the arm.

7. Suspension system according to claim 6 wherein the horizontally directed face of the suspension element via a sloping face merges into the vertical hook portion of said element.

8. Suspension system according to claim 1, wherein the tubular part is elongated in the vertical direction, the vertical side walls of the tubular part of each sectional bar are slightly curved inwards.

* * * * *